US006779870B2

(12) United States Patent
Watanabe et al.

(10) Patent No.: US 6,779,870 B2
(45) Date of Patent: Aug. 24, 2004

(54) INK-JET RECORDING APPARATUS

(75) Inventors: Hidehiro Watanabe, Tokyo (JP); Atsushi Kubota, Shizuoka-ken (JP); Megumi Shimizu, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 16 days.

(21) Appl. No.: 10/100,625

(22) Filed: Mar. 18, 2002

(65) Prior Publication Data

US 2002/0171708 A1 Nov. 21, 2002

(30) Foreign Application Priority Data

May 16, 2001 (JP) ..... 2001-146714
Aug. 29, 2001 (JP) ..... 2001-260304

(51) Int. Cl.[7] ..... B41J 2/145; B41J 2/15
(52) U.S. Cl. ..... 347/40
(58) Field of Search ..... 347/40, 41, 43, 347/20, 42

(56) References Cited

U.S. PATENT DOCUMENTS 5,600,354 A * 2/1997 Hackleman et al. ..... 347/50
6,231,157 B1 * 5/2001 Saijo ..... 347/33
6,350,011 B1 * 2/2002 Karlinski ..... 347/40
6,467,898 B2 * 10/2002 Codos et al. ..... 347/102

FOREIGN PATENT DOCUMENTS

| | | | |
|---|---|---|---|
| EP | 0960737 | A1 | 12/1999 |
| EP | 0968832 | A1 | 1/2000 |
| JP | 2891799 | B2 | 2/1999 |
| WO | WO 00/64680 | A1 | 11/2000 |

OTHER PUBLICATIONS

Patent Abstracts of Japan vol. 2000, No. 06, Sep. 22, 2000 & JP 2000 071482 A (Toshiba Tec Corp.), Mar. 7, 2000.

* cited by examiner

*Primary Examiner*—Thinh Nguyen
(74) *Attorney, Agent, or Firm*—Frishauf, Holtz, Goodman & Chick, P.C.

(57) ABSTRACT

Ink-jet heads having respective sets of ink ejection nozzles arranged longitudinally at a predetermined pitch are arranged in the moving direction of a sheet of art paper with a predetermined distance separating them from each other. The pitch Q separating the ink ejection nozzle of one of the ink-jet heads located at an end thereof from the corresponding ink ejection nozzle of the other ink-jet head located at the proximal end of the former ink ejection nozzle is made smaller the predetermined pitch P of arrangement of the ink ejection heads of the ink-jet heads.

6 Claims, 7 Drawing Sheets

| | | |
|---|---|---|
| ON | ON | ON |
| ON | X | ON |
| ON | ON | ON |

29

INK-JET RECORDING APPARATUS

CROSS-REFERENCE TO RELATED APPLICATIONS

This application is based upon and claims the benefit of priority from the prior Japanese Patent Applications No. 2001-146714, filed May 16, 2001; and No. 2001-260304, filed Aug. 29, 2001, the entire contents of both of which are incorporated herein by reference.

BACKGROUND OF THE INVENTION

1. Field of the Invention

This invention relates to an ink-jet recording apparatus using a plurality of ink-jet heads.

2. Description of the Related Art

Ink-jet recording apparatus using a serial type ink-jet head are currently in the main stream. This is because they have advantages including ease of maintenance due to the small number of ink ejection nozzles that the ink-jet head has and low manufacturing cost.

On the other hand, however, a serial type ink-jet head has disadvantages including that the width over which it can apply ink for printing in a single scanning operation is limited because of the limited number of ink ejection nozzles it has. Therefore, the ink-jet head has to be made to scan for a number of times before printing an entire page so that it takes a long time for printing a page.

Meanwhile, a long ink-jet head formed by arranging a large number of ink ejection nozzles can apply ink over a large width for printing in a single scanning operation because of the large number of ink ejection nozzles it has. Therefore, the ink-jet head can print an entire page with a reduced number of scanning cycles and hence is adapted to realize high speed printing.

However, a long length type ink-jet head has disadvantages including difficulty of manufacturing due to the large number of ink ejection nozzles it has. Therefore, the manufacturing yield is low and the cost is high.

There is known a technique of forming a long length head by combining a plurality of ink-jet heads each of which has a relatively small number of ink ejection nozzles for the purpose of dissolving these problems.

FIG. 15 illustrates a known ink-jet recording apparatus comprising a combination of a plurality of ink-jet heads.

As shown, an ink-jet head 2 is fitted to an end of a holding substrate 1 at a lateral side thereof while another ink-jet head 3 is fitted to the opposite end of the holding substrate 1 at the other lateral side thereof to form a long length head. A sheet conveyor belt 4 is arranged below said ink-jet heads 2 and 3, spaced apart from the heads 2 and 3. The belt 4 conveys the recording sheet 5, making it pass below the ink-jet heads 2 and 3 in a direction away from the viewer of FIG. 15.

FIG. 16 illustrates the positional relationship of the ink ejection nozzles $\mathbf{2}_1, \mathbf{2}_2, \mathbf{2}_3, \ldots, \mathbf{2}_{n-2}, \mathbf{2}_{n-1}, \mathbf{2}_n$ of the ink-jet head 2 and the ink ejection nozzles $\mathbf{3}_1, \mathbf{3}_2, \mathbf{3}_3, \ldots, \mathbf{3}_{n-2}, \mathbf{3}_{n-1}, \mathbf{3}_n$ of the ink-jet head 3 that can be observed when said ink-jet heads 2 and 3 are viewed from above.

The ink ejection nozzles of each of the ink-jet heads 2 and 3 are arranged at a pitch P. The most closely located ink ejection nozzles $\mathbf{2}_1$ and $\mathbf{3}_n$ of the ink-jet heads 2 and 3 are also separated from each other by a distance equal to P.

The ink-jet head of this ink-jet recording apparatus can be used to print over a large width just like a long length ink-jet head by regulating the moving speed of the recording sheet 5 relative to the ink-jet heads 2 and 3 and the timings of ejecting ink of the ink-jet heads 2 and 3.

More specifically, in this ink-jet recording apparatus, is adapted to print characters for a line by means of the ink-jet head 2 prints the first half of a line, and the ink-jet heat 3 prints the remaining half of the line after a predetermined time. With this arrangement, the apparatus prints a line of characters as if it printed by means of a single head.

However, with this ink-jet recording apparatus, there is a time lag before the ink-jet head 3 starts printing after the end of the printing operation of the ink-jet head 2 for the line. Then, the ink ejected from the ink-jet head 2 and the ink ejected from the ink-jet head 3 behave differently in terms of the extent of ink absorption of the recording sheet 5 and the extent of ink drying.

Therefore, there can occur a phenomenon that ink layer of the part of the image on the recording sheet formed by the ink ejected from the ink-jet head 2 and that of the part of the image formed by the ink ejected from the ink-jet head 3 differ from each other along the boundary thereof.

In other words, the ink layer 6 of the image formed by the ink-jet heads 2 and 3 on the recording sheet 5 can show a recess a at the connecting portion of the image as shown in FIG. 17.

As the recess a is formed in the ink layer 6, the recess a appears as a stripe-shaped deviated density zone when the entire image is viewed from above. The defect of the image due to such a stripe-shaped deviated density zone is conspicuous because it is produced as a linear defect.

BRIEF SUMMARY OF THE INVENTION

The object of the present invention is to provide an ink-jet recording apparatus that can form an ink layer uniform in thickness even at a junction between a part printed by an ink-jet head and another part printed by another ink-jet head.

According to an aspect of the invention, there is provided an ink-jet recording apparatus that comprises a plurality of ink-jet heads, each having a plurality of ink ejection nozzles arranged at a predetermined pitch. The ink-jet heads are arranged at predetermined intervals in the direction in which a recording medium is moved. The ink ejection nozzles of each head are arranged in a line crossing the direction in which the recording medium is moved. The ink-jet heads are driven at different times so that the dots they print on the medium align with one another, forming a straight line. The ink-jet heads are so arranged that the distance between the outermost nozzle of one head and the adjacent nozzle of the next head is shorter than the predetermined pitch at which the nozzles of any head are arranged.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitutes a part of the specification, illustrate embodiments of the invention, and together with the general description given above and the detailed description of the embodiments given below, serves to explain the principles of the invention.

DETAILED DESCRIPTION OF THE INVENTION (1st Embodiment)

Figure 1:
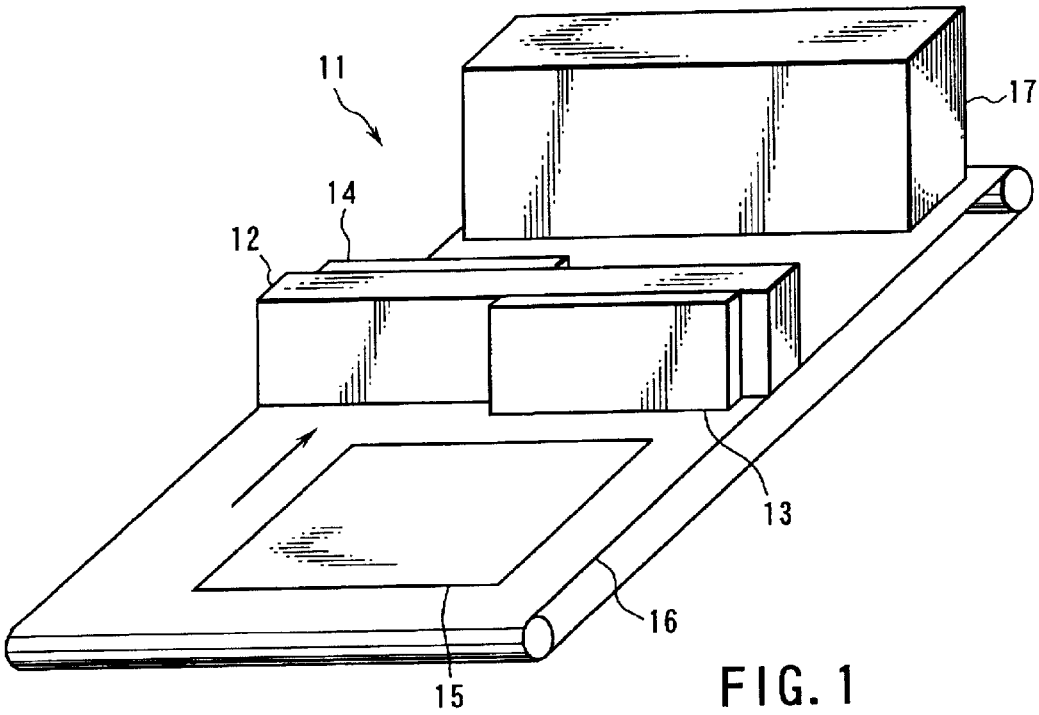
FIG. 1 is a perspective view of an ink-jet recording apparatus according to the first embodiment of the invention.

FIG. 1 shows the configuration of the ink-jet recording apparatus 11. More specifically, the ink-jet recording apparatus 11 comprises a long length ink-jet head 13 held at an end of a holding substrate 12 on a lateral side thereof and another long length ink-jet head 14 held at the other end of the holding substrate 12 on the other side thereof.

A conveyor belt 16 for conveying a recording sheet of art paper 15 in a direction away from the viewer of FIG. 1 is arranged below the ink-jet heads 13 and 14 and separated from them by a predetermined distance.

An ultraviolet irradiation unit 17 is arranged above the distal end of the conveyor belt 16.

Figure 2:
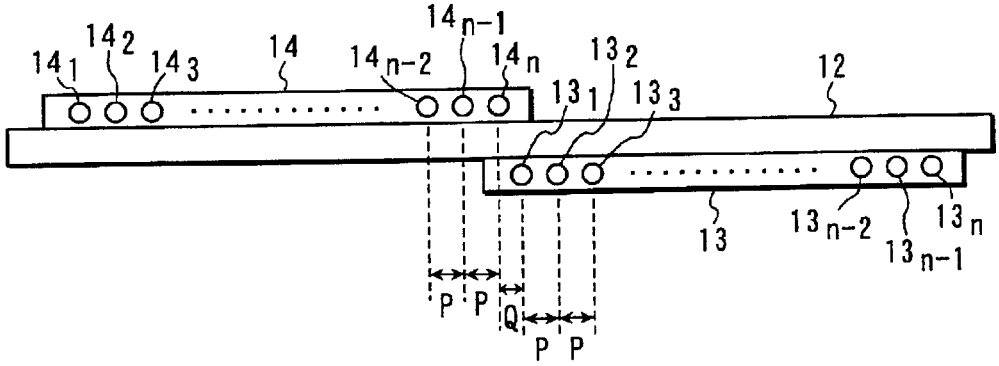
FIG. 2 shows the arrangement of ink ejection nozzles of the ink-jet heads of the first embodiment.

FIG. 2 is a schematic illustration of the arrangement of ink ejection nozzles of the ink-jet heads 13 and 14 as viewed from above.

Said ink-jet head 13 has a plurality of ink ejection nozzle $\mathbf{13}_1$, $\mathbf{13}_2$, $\mathbf{13}_3$, . . . , $\mathbf{13}_{n-2}$, $\mathbf{13}_{n-1}$, $\mathbf{13}_n$ arranged longitudinally at a pitch P.

Said ink-jet head 14 has a plurality of ink ejection nozzles $\mathbf{14}_1$, $\mathbf{14}_2$, $\mathbf{14}_3$, . . . , $\mathbf{14}_{n-2}$, $\mathbf{14}_{n-1}$, $\mathbf{14}_n$ arranged longitudinally also at the pitch P.

The ink ejection nozzles $\mathbf{13}_1$, $\mathbf{13}_2$, $\mathbf{13}_3$, . . . , $\mathbf{13}_{n-2}$, $\mathbf{13}_{n-1}$, $\mathbf{13}_n$ and $\mathbf{14}_1$, $\mathbf{14}_2$, $\mathbf{14}_3$, . . . , $\mathbf{14}_{n-2}$, $\mathbf{14}_{n-1}$, $\mathbf{14}_n$ of the ink-jet heads 13 and 14 are arranged in a direction orthogonal relative to the direction in which the sheet of art paper 15 that is a recording medium.

The most closely located ink ejection nozzles $\mathbf{13}_1$ and $\mathbf{14}_n$ of the ink-jet heads 13 and 14 are arranged on said holding substrate 12 in such a way that they are separated from each other by a distance equal to a pitch Q that is smaller than the pitch P. The pitch P is typically equal to 1/300 inches, or 85 $\mu$m. The pitch Q is about 70% of the pitch P, or 60 $\mu$m.

Ink to be used by means of said ink-jet heads 13 and 14 ultraviolet-set type ink that is set by electromagnetic waves in the ultraviolet wavelength range and shows a viscosity of 10 mPas.

The distance between the ink ejection nozzles of the ink-jet head 13 and those of the ink-jet head 14 in the direction of conveying the sheet of art paper 15 is 10 cm. The sheet of art paper 15 is moved at a rate of 40 cm/s.

The pitch Q needs to be not smaller than 50% of the pitch P because the quality of the output image can be degraded if it is too small relative to the pitch P. Preferably, the pitch Q is about 70% of the pitch P.

Figure 3:
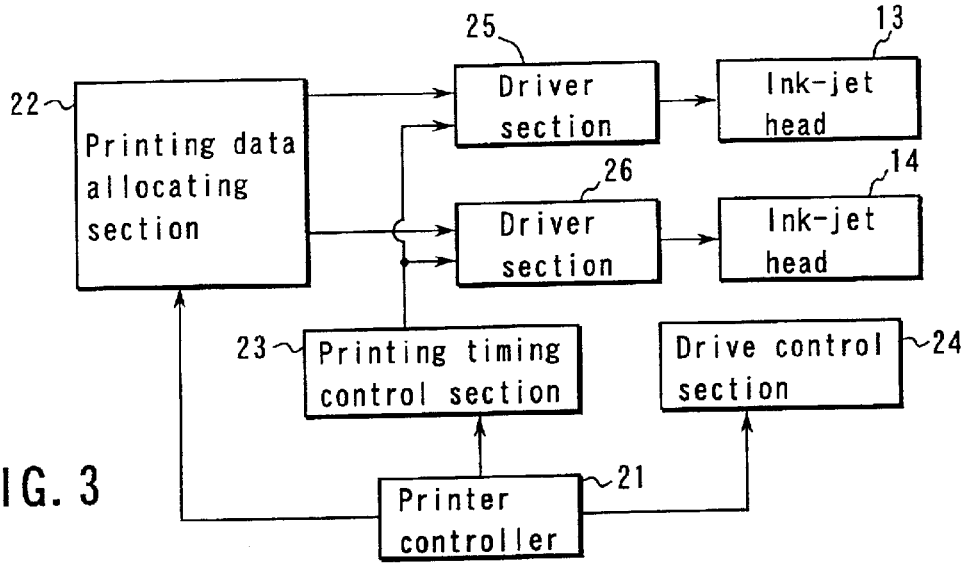
FIG. 3 is a block diagram of the control section of the first embodiment.

As FIG. 3 shows, the printing control section of said ink-jet recording apparatus 11 comprises a printer controller 21. The printer controller 21 controls a printing data allocating section 22, a timing control section 23, and a drive control section 24, by using a predetermined control program. The printing data allocating section 22 distributes print data. The timing control section 23 controls the print timing. The drive control section 24 controls mechanical components including the conveyor belt 16.

The printing data allocating section 22 allocates the printing data it receives from outside to driver sections 25, 26, each comprising a shift register, a latch and a driver.

The driver section 25 drives said ink-jet head 13 at the timing indicated by the control signal from the printing timing control section 23 according to the printing data from the printing data allocating section 22.

The driver section 26 drives said ink-jet head 14 at the timing indicated by the control signal from said printing timing control section 23 according to the printing data from the printing data allocating section 22.

The ink-jet heads 13 and 14 are driven in synchronism with the transfer speed of 40 cm/s at which said drive control section 24 transfers the sheet of art paper 15.

Figure 4:
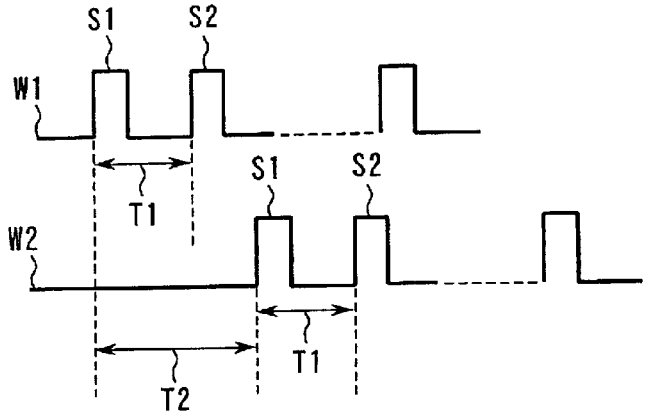
FIG. 4 depicts the waveforms of the control signals transmitted from the printing timing control section to the driver sections of FIG. 3.

FIG. 4 is a schematic illustration of the waveforms of the control signals transmitted from the printing timing control section 23 to the driver sections 25, 26 respectively.

Referring to FIG. 4, waveform W1 shows the control signal to said driver section 25 and waveform W2 shows the control signal to said driver section 26. Said waveforms W1, W2 produce timing signals S1, S2 with a predetermined cycle period T1 in order to operate the ink-jet heads 13 and 14 for printing each line.

The waveform W2 is delayed by time period T2 that corresponds to the distance of 10 cm between the ink ejection nozzles of the ink-jet head 13 and those of the ink-jet head 14 in the direction of transferring the sheet of art paper 15 from the waveform W1.

The printing timing control section 23 delays the timing of printing said sheet of art paper 15 by means of the ink ejection nozzles of the ink-jet head 13 by a time period T2 from the timing of printing by means of the ink ejection nozzles of the ink-jet head 14.

The operation of printing characters on said sheet of art paper is conducted in such a way that the lines printed respectively by the ink-jet heads 13 and 14 are exactly aligned. Therefore, the outcome is same as the one obtained by using a single long length ink-jet head.

Now, the operation of the ink-jet recording apparatus 11 will be described below.

Upon receiving printing data from outside, the printer controller 21 controls the drive control section 24 and supplies a sheet of art paper 15 to the sheet conveyor belt 16. The sheet of art paper 15 is conveyed at a rate of 40 cm/s by the conveyor belt 16 so as to move away from the viewer.

Then, the printer controller 21 controls the printing data allocating section 22 to allocate the received printing data to the driver sections 25, 26. Thereafter, it synchronizes the timing of moving the sheet of art paper 15 and that of printing characters by means of the printing timing control section 23. Then, the ink-jet head 13 operates for printing and, after the elapse of the time period T2, the ink-jet head 14 operates for printing.

In this way, the ink-jet heads 13 and 14 prints characters on the sheet of art paper 15 with a lag of the time period T2 according to the printing data allocated to them. As a result, an ink layer of the output image is formed on the sheet of art paper 15.

The sheet of art paper 15 on which characters have been printed is moved to the distal end of the conveyor belt 16 and irradiated with ultraviolet rays by means of the ultraviolet irradiation unit 17. The ink layer on the sheet of art paper 15 is fixed as a result of the irradiation of ultraviolet rays.

Figure 5:
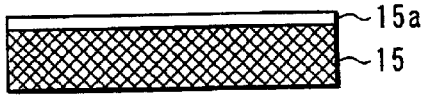
FIG. 5 is a partial cross sectional view of an art-paper sheet carrying an ink layer formed by the first embodiment.

FIG. 5 is a schematic cross sectional view of the sheet of art paper 15 on which characters have been printed. As shown, an ink layer 15*a* having a thickness of 2 to 5 $\mu$m is formed on the 150 to 200 $\mu$m thick sheet of art paper 15.

The connecting portion of the ink layer that links the parts of the image located at the middle point of the ink layer 15*a* is formed by the most closely located ink ejection nozzles of the ink-jet heads 13 and 14. Since the ink ejection nozzle $\mathbf{13}_1$ of the ink-jet head 13 and the ink ejection nozzle $\mathbf{14}_n$ of the ink-jet head 14 are separated by the pitch Q that is smaller than the pitch P, no recess is formed along the connecting portion of the image so as not to give rise to any deviation of density. Therefore, the ink layer formed on the sheet of art paper 15 shows substantially a uniform thickness to prevent a defective image due to a deviated density from taking place.

The sheet of art paper 15 that is finished with the printing operation is completed is delivered from the ink-jet recording apparatus 11.

While this embodiment of ink-jet recording apparatus uses ultraviolet-set type ink that is set by electromagnetic waves in the ultraviolet wavelength range, the present invention is by no means limited thereto. For example, electron beam-set type ink that is set by electromagnetic waves in some other wavelength range may alternatively be used.

While the ink-jet heads 13 and 14 of this embodiment of ink-jet recording apparatus are secured to the holding substrate 12 with the pitch Q separating the ink ejection nozzles, the present invention is by no means limited thereto. For example, it may alternatively by so arranged that one of the ink-jet heads is movable by a predetermined distance in a direction orthogonal to the moving direction of the sheet of art paper 15 and the pitch Q is regulated by moving the ink-jet head by means of a distance regulating mechanism.

Figure 6:
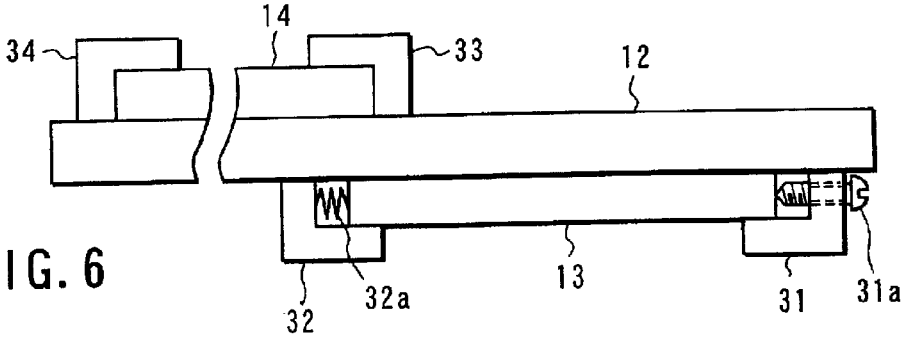
FIG. 6 illustrates the mechanism for regulating the distance between the most closely located ink ejection nozzles of two ink-jet heads.

FIG. 6 is a schematic illustration of the configuration of the regulation mechanism. More specifically, the distance regulating mechanism holds the ink-jet head 13 arranged on one of the lateral sides of the holding substrate 12 between a securing metal fitting 31 provided with a screw tap and another securing metal fitting 32 provided in the inside with a leaf spring 32*a*. The ink-jet head 13 is set in position so as to contact the leaf spring 32*a* at an end thereof and the finely threaded screw 31*a* driven into the screw tap of the securing metal fitting 31 at the other end thereof.

Similarly, the ink-jet head 14 is secured in position on the other lateral sides of the holding substrate 12 by means of a pair of securing metal fittings 33, 34.

The distance regulating mechanism is adapted to longitudinally slide the ink-jet head 13 by means of rotary movement of the finely threaded screw 31*a* in order to regulate the pitch Q between the ink ejection nozzle $\mathbf{13}_1$ and the ink ejection nozzle $\mathbf{14}_n$ so as to make it smaller than the pitch P of arrangement of the ink ejection nozzles.

If the finely threaded screw 31*a* is so adapted that it advances by 0.5 mm with a single turn, the ink-jet head 13 slides by 5 $\mu$m as the finely threaded screw 31*a* is turned by 3.60. The pitch Q is so regulated that the ink layer 15*a* formed on the sheet of art paper 15 by printing shows a uniform thickness.

The pitch Q can be regulated more finely and accurately by using a differential screw.

While the ink-jet head 13 is driven to slide longitudinally in order to regulate the pitch Q in the above description, the ink-jet head 14 may alternatively be driven to slide longitudinally in order to regulate the pitch Q.

(2nd Embodiment)

The components of the second embodiment same as those of the first embodiment are denoted respectively by the same reference symbols.

Figure 7:
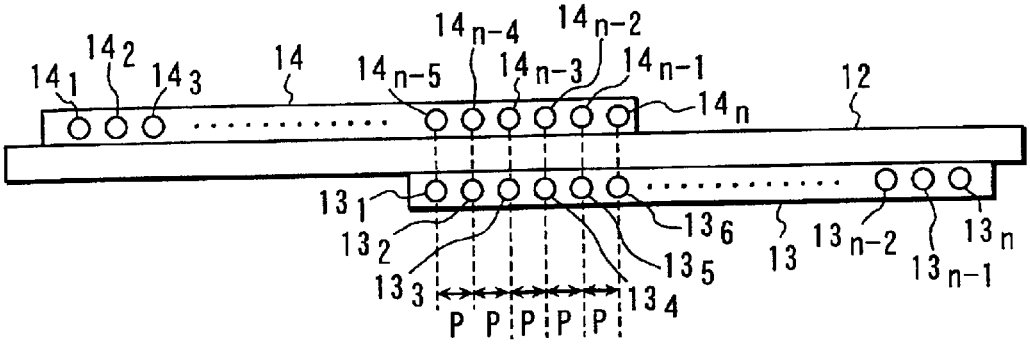
FIG. 7 shows the arrangement of ink ejection nozzles of any two adjacent ink-jet heads of the second embodiment of the invention.

In this embodiment of ink-jet recording apparatus, the ink-jet head 13 and the ink-jet head 14 are arranged on the holding substrate 12 in a manner as illustrated in FIG. 7. More specifically, the six ink ejection nozzles $\mathbf{13}_1$, $\mathbf{13}_2$, $\mathbf{13}_3$, $\mathbf{13}_4$, $\mathbf{13}_5$, $\mathbf{13}_6$ of the ink-jet head 13 respectively overlap the six ink ejection nozzles $\mathbf{14}_{n-5}$, $\mathbf{14}_{n-4}$, $\mathbf{14}_{n-3}$, $\mathbf{14}_{n-2}$, $\mathbf{14}_{n-1}$, $\mathbf{14}_n$ of the ink-jet head 14 of the ink-jet recording apparatus in the moving direction of the sheet of art paper 15.

Figure 8:
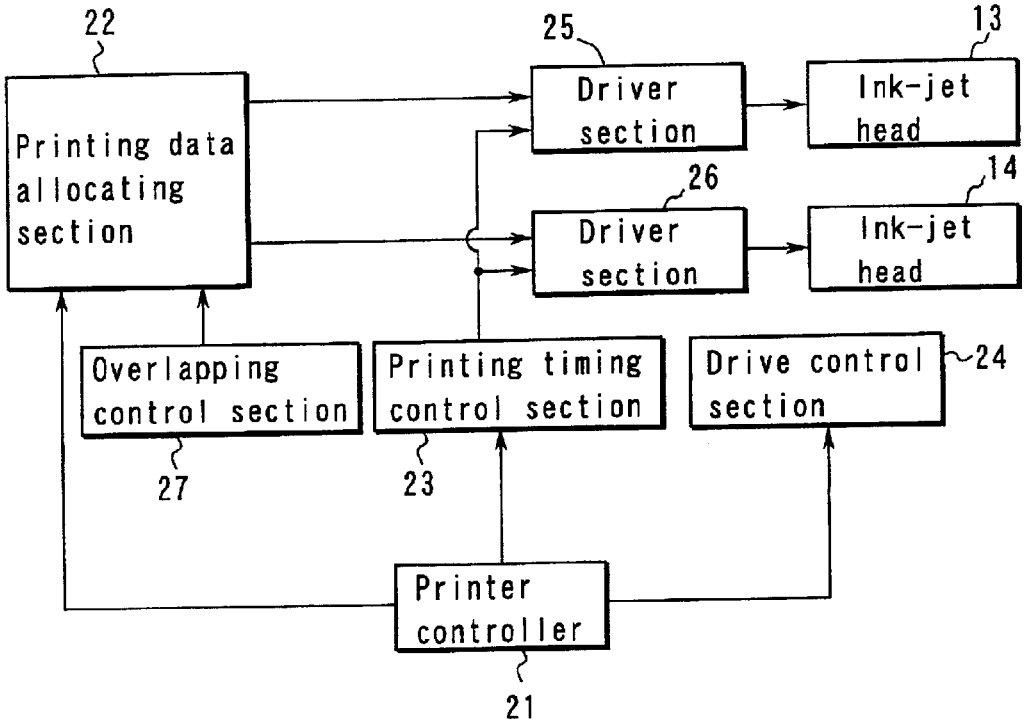
FIG. 8 is a block diagram of the control section provided in the second embodiment.

FIG. 8 is a schematic block diagram of the control section of the second embodiment, illustrating its configuration. Referring to FIG. 8, upon receiving printing data as input, the printing data allocating section 22 corrects the position of each overlapping part of the printing data by referring to an overlap correction table 27 in such a way that the part may be printed by either or both of the ink-jet heads 13 and 14. The printing data allocating section 22 then allocates the corrected printing data to the driver sections 25, 26.

Additionally, when printing in the overlapping printing area of a predetermined line, at least a dot is formed by ink droplets ejected from both of the ink-jet heads 13 and 14.

Now, the positional dot arrangement for printing in the overlapping printing area of a predetermined line will be described below.

Figure 9:
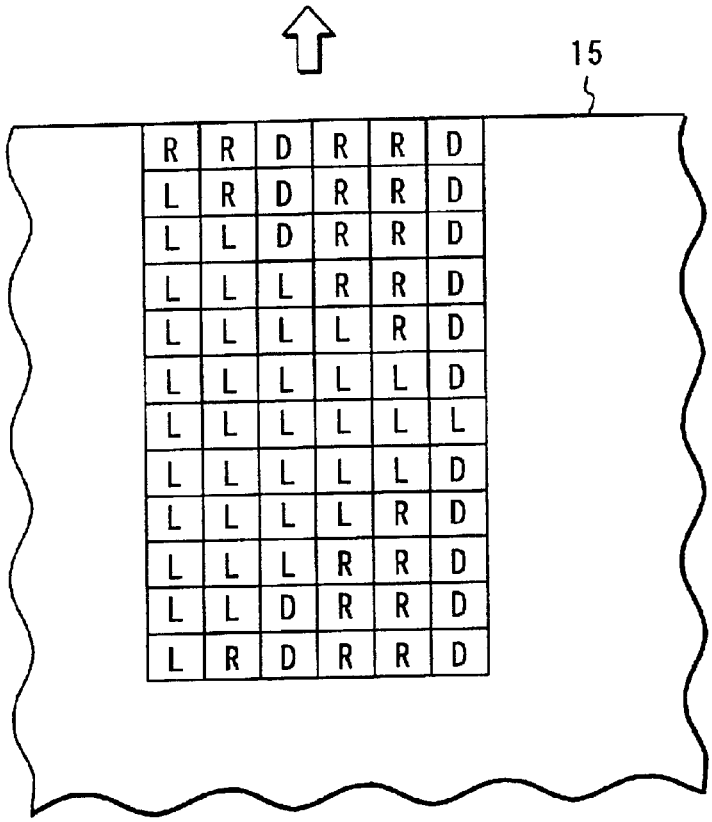
FIG. 9 shows the positions of dots that the second embodiment prints in an overlapping printing area on an art-paper sheet.

FIG. 9 is a schematic illustration of the positions of printed dots in an overlapping printing area of a predetermined line on a sheet of art paper 15.

In FIG. 9, each position indicated by R denotes a position to which ink is ejected from the ink-jet head 13 and each position indicated by L denotes a position to which ink is ejected from the ink-jet head 14, whereas each position indicated by D denotes a position to which ink is ejected from both of the ink-jet heads 13 and 14.

Figure 10A:
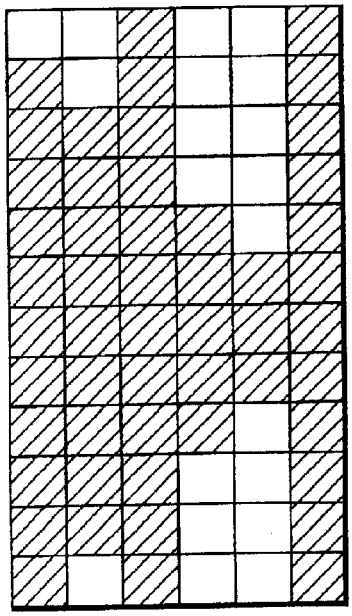
FIG. 10A depicts the positions of the dots that one of the ink-jet heads prints at an overlapping printing area of an image.
Figure 10B:
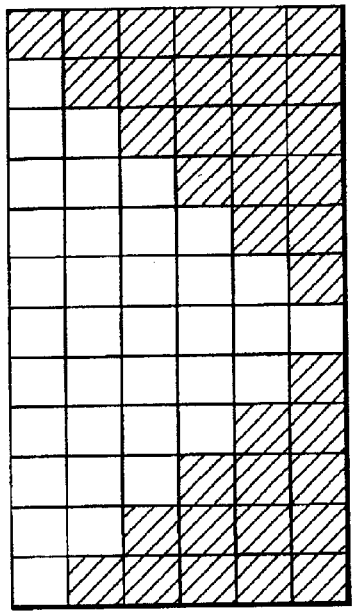
FIG. 10B shows the positions of the dots that another ink-jet head prints at the overlapping printing area of an image.

FIGS. 10A and 10B are schematic illustrations of the positions of the dots printed by each of the two ink-jet heads in the overlapping printing area of FIG. 9.

FIG. 10A is a schematic illustration of the positions of the dots printed by the ink-jet head 13 in the overlapping printing area. FIG. 10B is a schematic illustration of the positions of the dots printed by the ink-jet head 14 in the overlapping printing area. In FIGS. 10A and 10B, the shaded regions indicate dots formed by ink ejected from the corresponding one of the ink-jet heads, whereas white regions indicate the regions to which no ink is ejected from that ink-jet head.

Note that the above expression means that each dot is formed by ink ejected from either the ink-jet head 13 or the ink-jet head 14 only when necessary. In other words, each dot does not necessarily be formed.

Also note that the overlapping printing area in each of FIGS. 9, 10A and 10B is the smallest unit area. Such an area appears repeatedly along the moving direction of the sheet of art paper 15.

Note that the printed dots shown in the overlapping printing area are shown only as an example that can make the ink layer show a substantially uniform thickness along the boundary of the territories of the ink-jet heads 13 and 14 under specific conditions. The positions of the dots along the boundary for which the ink-jet heads are responsible can vary when the conditions change.

The regions in the overlapping printing area along the boundary of the ink-jet heads 13 and 14 are defined for printing in this way. At least a pair of ink ejection nozzles that belongs to the ink-jet heads 13 and 14 ejects ink to form respective dots in an overlapping manner in each of certain regions in the overlapping printing area when printing in a predetermined line. In this way, the ink layer on the sheet of art paper 15 comes to show a uniform thickness.

Thus, the part of the image, which connects the parts printed by the ink-jet heads 13 and 14, is prevented from becoming thicker or thinner than the parts printed by the heads 13 and 14.

In this embodiment, the ink-jet heads are arranged on the holding substrate 12 in such a way that six ink ejection nozzles of the ink-jet heads 13 and those of the ink-jet head 14 are respectively made to overlap along the boundary of the ink-jet heads in the moving direction of the sheet of art paper 15. However, this embodiment is by no means limited thereto. In other words, the ink-jet heads 13 and 14 may be arranged to prevent the part of the image, which connects the parts printed by the ink-jet heads 13 and 14, from becoming thicker or thinner than the parts printed by the heads 13 and 14. To arrange the heads 13 and 14 so, the type of the recording medium (e.g., an art-paper sheet 15), the ink and the ultraviolet-setting property of the ink, and the like are taken into consideration. The optimal positional arrangement of the ink ejection nozzles can be determined in advance by way of experiments.

(3rd Embodiment)

The components of the third embodiment same as those of the first and second embodiments are denoted respectively by the same reference symbols.

Figure 11:
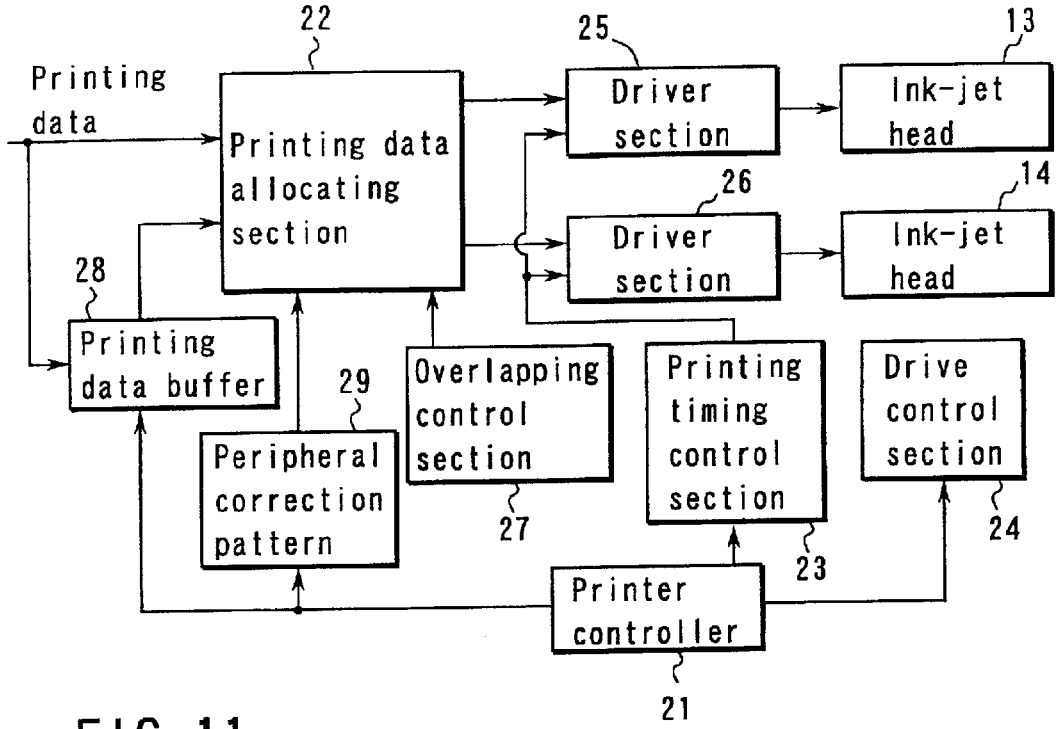
FIG. 11 is a block diagram of the control section of the third embodiment of the invention.

As shown in FIG. 11, printing data are input from the outside to the printing data allocating section 22 and the printing data buffer 28 of this embodiment of ink-jet recording apparatus.

For each overlapping printing area, the printing data allocating section 22 allocates the printing data by referring to the data of the overlapping correction table 27, the peripheral correction data pattern stored in the peripheral correction pattern storage section 29 and the printing data of the printing data buffer 28.

Figure 12:
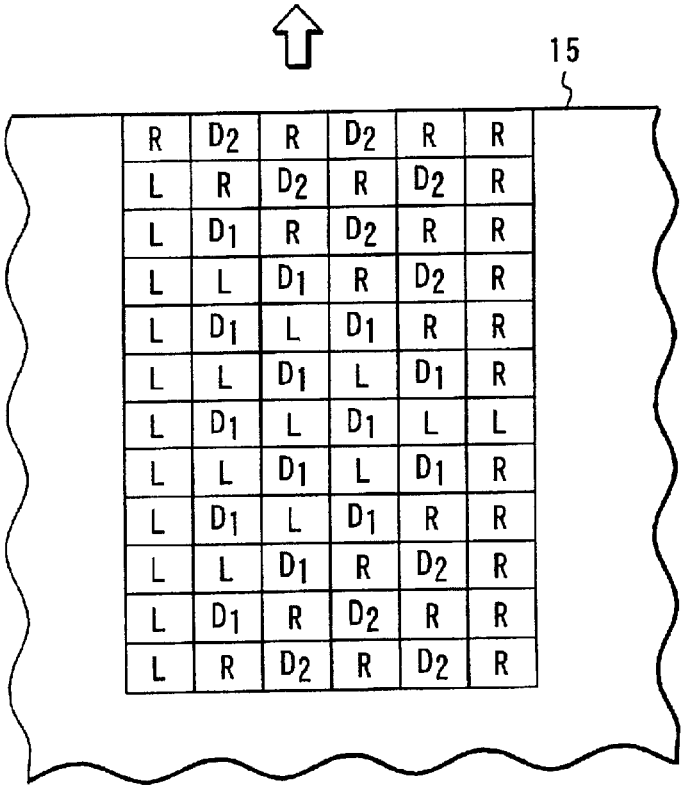
FIG. 12 illustrates the positions of printed dots that the third embodiment prints on an art-paper sheet, at an overlapping printing area of an image.

FIG. 12 schematically illustrates how printing data are allocated in the regions of an overlapping printing area. The allocation data to be used for this data allocation are stored in the overlapping correction table 27. In FIG. 12, each position indicated by R denotes a position to which ink is ejected from the ink-jet head 13 and each position indicated by L denotes a position to which ink is ejected from the ink-jet head 14, whereas each position indicated by $D_1$ or $D_2$ denotes a position to which ink is ejected from both of the ink-jet heads 13 and 14.

Figures 13, 14:
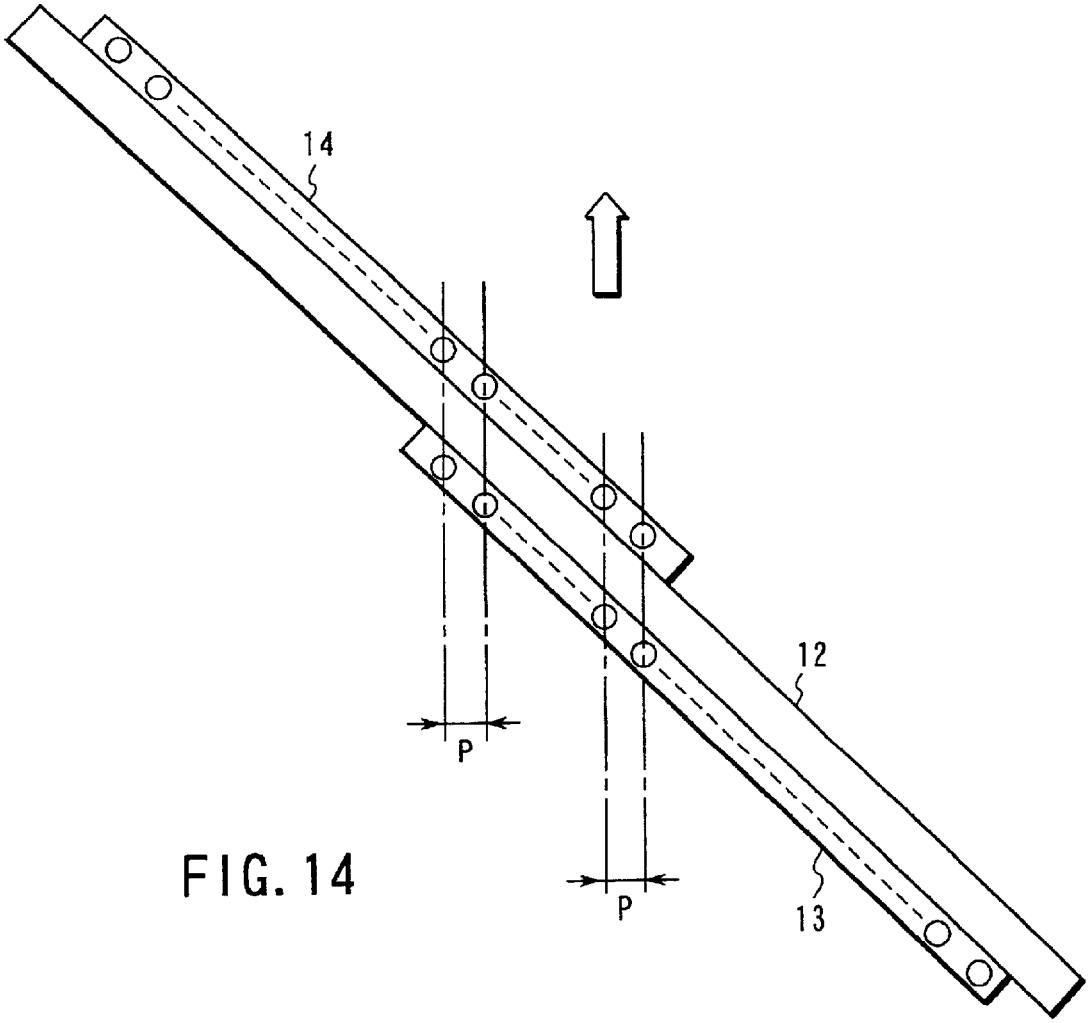
FIG. 13 shows the peripheral correction pattern stored in the peripheral correction pattern storage section of the third embodiment.
FIG. 14 depicts the arrangement of heads of another embodiment according to the invention.
Figure 15:
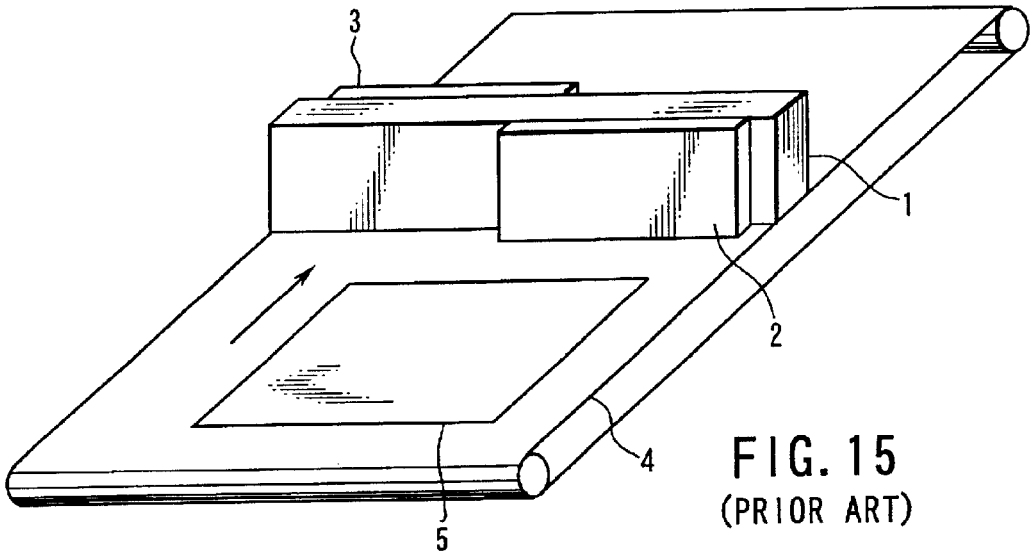
FIG. 15 (PRIOR ART)
FIG. 15 is a view of a known ink-jet recording apparatus.
Figure 16:
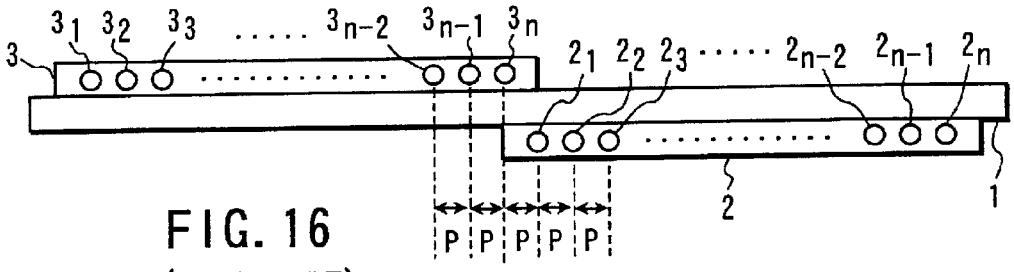
FIG. 16 (PRIOR ART)
FIG. 16 shows the arrangement of the ink ejection nozzles of the ink-jet heads of the apparatus of FIG. 16.
Figure 17:
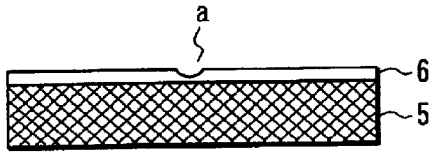
FIG. 17 (PRIOR ART)
FIG. 17 is a partial cross sectional view of an art-paper sheet carrying an ink layer formed by the known ink-jet recording apparatus of the prior art.

The peripheral correction pattern storage section 29 stores a pattern that can be obtained when all the peripheral eight pixels of a dot X in question are ON and hence used for printing as peripheral correction pattern as shown in FIG. 13.

Note, however, the peripheral correction pattern is not limited to the one illustrated in FIG. 13. The peripheral correction pattern can be determined optimally in advance by way of experiments by taking the conditions including the ink and the paper to be used for printing and the required level of resolution.

Additionally, the number of patterns is not limited to one. If necessary, more than one patterns may be used.

The given data are for an overlapping printing area, the printing data allocating section 22 allocates the printing data by referring to the data of the overlapping correction table 27 so that ink may be ejected from either or both of the ink-jet heads 13 and 14 to each region in the overlapping printing area.

If the dot X in question is located at a dot position $D_1$ and the eight peripheral pixels of the dot X shows the pattern stored in the peripheral correction pattern storage section 29, the printing data allocating section 22 allocates the printing data to the ink-jet heads 13 and 14 in such a way that ink is ejected from both the ink-jet heads 13 and 14 in the defined manner. If, on the other hand, the eight peripheral pixels of the dot X in question shows a pattern different from the pattern stored in the peripheral correction pattern storage section 29, the printing data allocating section 22 allocates the printing data in such a way that ink is ejected only from the ink-jet head 13.

If the dot X in question is located at a dot position $D_2$ and the eight peripheral pixels of the dot X shows the pattern stored in the peripheral correction pattern storage section 29, the printing data allocating section 22 allocates the printing data to the ink-jet heads 13 and 14 in such a way that ink is ejected from both the ink-jet heads 13 and 14 in the defined manner. If, on the other hand, the eight peripheral pixels of the dot X in question shows a pattern different from the pattern stored in the peripheral correction pattern storage section 29, the printing data allocating section 22 allocates the printing data in such a way that ink is ejected only from the ink-jet head 14.

The effect of the embodiment will be described below.

For printing an overlapping printing area that corresponds to a connecting portion of the of the ink-jet heads 13 and 14 according to printing data, the ink-jet recording apparatus prints the dot X in question that is to be printed by ejecting ink from the ink-jet head 13 if the dot X is located at a dot position R. On the other hand, the ink-jet recording apparatus prints the dot X in question that is to be printed by ejecting ink from the ink-jet head 14 if the dot X is located at a dot position L.

If the dot X in question that is to be printed is located a dot position $D_1$, the ink-jet recording apparatus reads the dot pattern of the peripheral eight pixels of the dot X from the printing data stored in the printing data buffer 28 and compares the dot pattern it has read with the pattern stored in the peripheral correction pattern storage section 29. If the dot pattern it has read is other than the pattern stored in the peripheral correction pattern storage section 29, the ink-jet recording apparatus prints the dot X in question by ejecting ink from the ink-jet head 13. If, on the other hand, the dot pattern it has reads is same as the pattern stored in the peripheral correction pattern storage section 29, the ink-jet recording apparatus prints the dot X in equation by ejecting ink from both of the ink-jet heads 13 and 14.

Similarly, if the dot X in question that is to be printed is located a dot position $D_2$, the ink-jet recording apparatus reads the dot pattern of the peripheral eight pixels of the dot X from the printing data stored in the printing data buffer 28 and compares the dot pattern it has read with the pattern stored in the peripheral correction pattern storage section 29. If the dot pattern it has read is other than the pattern stored in the peripheral correction pattern storage section 29, the ink-jet recording apparatus prints the dot X in question by ejecting ink from the ink-jet head 14. If, on the other hand, the dot pattern it has read is same as the pattern stored in the peripheral correction pattern storage section 29, the ink-jet recording apparatus prints the dot X in equation by ejecting ink from both of the ink-jet heads 13 and 14.

By printing an image in this way, the ink layer of the printed image shows a substantially uniform thickness in each overlapping printing area that corresponds to a connecting portion of the ink-jet heads 13 and 14.

In this way, the part of the image, which connects the parts printed by the ink-jet heads 13 and 14, from becoming thicker or thinner than the parts printed by the heads 13 and 14.

In this embodiment, the ink-jet heads are arranged on the holding substrate 12 in such a way that six ink ejection nozzles of the ink-jet heads 13 and those of the ink-jet head 14 are respectively made to overlap along the boundary of the ink-jet heads in the moving direction of the sheet of art paper 15. However, this embodiment is by no means limited thereto. In other words, the ink-jet heads 13 and 14 may be optimally arranged so as to prevent defects due to deviated density from taking place in the connecting portion of the image output by the ink-jet heads 13 and 14, taking the conditions including the recording medium which may be a sheet of art paper 15, the ink and the ultraviolet-setting property of the ink into consideration. The optimal positional arrangement of the ink ejection nozzles can be determined in advance by way of experiments.

The ink ejection nozzles of the ink-jet heads 13 and 14 of each of the above described embodiments are arranged in a direction orthogonal relative to the direction in which the sheet of art paper that is a recording medium. However, the present invention is by no means limited thereto.

For example, the ink-jet heads 13 and 14 that are rigidly secured to the holding substrate 12 may be arranged in a line inclined to the moving direction of the sheet of art paper. Then, the ink ejection nozzles of the ink-jet heads 13 and 14 are arranged in a direction that crosses the moving direction of the sheet of art paper.

With such an arrangement, the pitch of arrangement of the ink ejection nozzles of each of the ink-jet heads 13 and 14 is greater than the pitch of arrangement of the printed dots on the sheet of art paper.

Therefore, the pitch of arrangement of the ink ejection nozzles of the ink-jet heads 13 and 14 is greater when the ink ejection nozzles are arranged in a direction that crosses the moving direction of the sheet of art paper than when they are arranged in a direction orthogonal relative to the moving direction of the sheet of art paper.

The above described mechanism for regulating the distance between the most closely located ink ejection nozzles of two ink-jet heads of the first embodiment can be used for an ink-jet recording apparatus in which the ink ejection nozzles of the ink-jet heads 13 and 14 are arranged in a direction inclined relative to and crosses the moving direction of the sheet of art paper.

While two ink-jet heads are arranged on the holding substrate 12 of each of the above described embodiments, the present invention is by no means limited thereto. Three or more than three ink-jet heads may alternatively be arranged on the holding substrate 12. In such a case again, the ink-jet heads are arranged in a manner as described above by referring to any of the embodiments for the connecting portions of the ink-jet heads.

While each of the above described embodiments of ink-jet recording apparatus according to the invention is adapted to print monochromatic characters, the present invention is by no means limited thereto. The present invention is equally applicable to color ink-jet recording apparatus adapted to print characters in multi-color.

Furthermore, while sheets of art paper are transferred as recording medium by means of a conveyor belt transfer system using a conveyor belt in each of the above described embodiments, the present invention is by no means limited thereto. A drum conveyor system or some other conveyor system may alternatively be used for transferring sheets of art paper for the purpose of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising:

a plurality of ink-jet heads, each having a plurality of ink ejection nozzles arranged at a predetermined pitch;

a recording medium adapted to be moved relative to said ink-jet heads; and a regulating mechanism for regulating a distance between any adjacent two of said ink jet heads;

wherein said ink-jet heads are spaced apart from each other at a predetermined distance in a moving direction of said ink-jet heads relative to said recording medium, and said ink ejection nozzles of said ink jet heads are arranged in a direction crossing a direction of relative movement of said recording medium;

wherein timings of printing of said ink ejection nozzles of each of said ink jet heads are made different such that dots printed by ink ejected from said ink ejection nozzles are arranged on a same line on the recording medium, when printing is performed on the same line on said recording medium; and wherein an outermost one of said ink ejection nozzles of one of said any adjacent two of said ink-jet heads is adjacent to an outermost one of said ink ejection nozzles of the other of said any adjacent two of said ink-jet heads, and said regulating mechanism performs adjustment such that a distance between said outermost ink ejection nozzles of said any adjacent two of said ink-jet heads is smaller than the predetermined pitch.

2. The apparatus according to claim 1, wherein said in jet ejection nozzles of said ink jet heads are arranged to be perpendicular to the direction of relative movement of said recording medium.

3. An ink-jet recording apparatus comprising:

a plurality of ink jet heads, each having a plurality of ink ejection nozzles arranged at a predetermined pitch;

a recording medium adapted to be moved relative to said ink-jet heads; and a correction table defined so as to cause ink to be ejected for each dot of a predetermined line;

wherein said ink-jet heads are spaced apart from each other at a predetermined distance in a moving direction of said ink-jet heads relative to said recording mediums and said ink ejection nozzles are arranged in a direction orthogonal to a relative movement of said recording medium;

wherein timings of printing characters of a line on said recording medium by means of the ink ejection nozzles of each of the ink-jet heads are regulated to accurately align dots printed by ink from the ink ejection nozzles;

wherein adjacent ink-jet heads are arranged such that respective sets of ink ejection nozzles of the adjacent ink-jet heads partly overlap each other;

wherein at least a dot is formed by ink ejected from a pair of ink ejection nozzles ejected respectively from two of the adjacent ink-jet heads having the respective sets of partly overlapping ink ejection nozzles;

wherein said correction table is defined so as to cause ink to be ejected from one of the overlapping ink ejection nozzles of at least one of the two adjacent ink-jet heads for each dot of a predetermined line;

wherein said correction table is defined so as to cause at least a dot of a predetermined line to be formed by ink ejected from all of at least a pair of ink ejection nozzles selected respectively from two adjacent ink-jet heads having the respective sets of partly overlapping ink ejection nozzles;

wherein, when a dot is printed in an area corresponding to a pair of the overlapping ink injection nozzles of adjacent ink jet heads, the ink is ejected from either of the pair of ink ejection nozzles if a predefined and predetermined pattern is formed by the ejection of ink for the peripheral pixels surrounding the dot.

4. The apparatus according to claim 3, wherein the ejection of ink from either of the ink-jet heads is defined for each dot of predetermined line.

5. Th apparatus according to claim 4, wherein said predefined and predetermined pattern is a pattern different from the pattern formed by ink ejected for all the eight peripheral pixels surrounding said dot.

6. Th apparatus according to claim 3, wherein said predefined and predetermined pattern is a pattern different from the pattern formed by ink ejected for all the eight peripheral pixels surrounding said dot.

* * * * *